US008092324B2

(12) United States Patent
Ashida et al.

(10) Patent No.: US 8,092,324 B2
(45) **Date of Patent: *Jan. 10, 2012**

(54) SHEET-LIKE OBJECT FOR BALL AND BALL

(75) Inventors: Tetsuya Ashida, Okayama (JP); Koki Ogata, Osaka (JP); Yoshiaki Yasuda, Okayama (JP); Taketoshi Saeki, Hiroshima (JP)

(73) Assignees: Kuraray Co., Ltd., Kurashiki-shi (JP); Mikasa Corporation, Hiroshima-shi (JP)

( * ) Notice: Subject to any disclaimer, the term of this patent is extended or adjusted under 35 U.S.C. 154(b) by 314 days.

This patent is subject to a terminal disclaimer.

(21) Appl. No.: 12/375,022

(22) PCT Filed: Jul. 24, 2007

(86) PCT No.: PCT/JP2007/064518

§ 371 (c)(1),
(2), (4) Date: Mar. 13, 2009

(87) PCT Pub. No.: WO2008/013177

PCT Pub. Date: Jan. 31, 2008

(65) Prior Publication Data

US 2010/0009792 A1 Jan. 14, 2010

(30) Foreign Application Priority Data

Jul. 26, 2006 (JP) ..... 2006-203679
Jul. 26, 2006 (JP) ..... 2006-203681

(51) Int. Cl.
*A63B 41/08* (2006.01)

(52) U.S. Cl. ..... 473/597; 473/604

(58) Field of Classification Search ..... 473/569, 473/573, 574, 594, 596, 603–605; 428/151, 428/904, 137, 138
See application file for complete search history.

(56) References Cited

U.S. PATENT DOCUMENTS 2,494,806 A * 1/1950 Gibson ..... 473/596
2,931,653 A * 4/1960 Gow et al. ..... 473/596
4,000,894 A * 1/1977 Butzen ..... 473/596

(Continued)

FOREIGN PATENT DOCUMENTS

CN 1593698 A 3/2005

(Continued)

*Primary Examiner* — Steven Wong
(74) *Attorney, Agent, or Firm* — Oblon, Spivak, McClelland, Maier & Neustadt, L.L.P.

(57) ABSTRACT

Provided are: a sheet-like ball material including a fibrous base material, and an elastic polymer cover layer that is laminated on a surface of the fibrous base material, in which continuous pebbles and discontinuous valleys are formed on a surface of the cover layer, the valleys discontinuously formed are formed at average intervals of 0.5 to 3 mm, the valley has a depth of 50 to 500 μm, a vertical projected area of each valley is 1 to 5 $mm^2$, and a total area of the vertical projected area of each valley accounts for 3 to 30% relative to a surface area of the elastic polymer cover layer; a ball used for volleyball or beach volleyball including the sheet-like ball material, which is excellent in the controllability for all types of ball plays such as tossing and serving in the smoothness of the attenuation degree in the ball speed of the ball during flight of the ball, and in the design, e.g., three-dimensional shape, which is not realized in a heretofore-existing ball, and also has a sufficient surface abrasion resistance; and a sheet-like ball material suitably used for such balls.

15 Claims, 3 Drawing Sheets

U.S. PATENT DOCUMENTS

| | | | | |
|---|---|---|---|---|
| 4,570,931 | A * | 2/1986 | Martin | 473/596 |
| 4,928,962 | A * | 5/1990 | Finley | 473/596 |
| 4,991,842 | A * | 2/1991 | Finley | 473/596 |
| 5,310,178 | A * | 5/1994 | Walker et al. | 473/605 |
| 5,518,234 | A * | 5/1996 | Palmquist | 473/596 |
| 5,669,838 | A * | 9/1997 | Kennedy et al. | 473/596 |
| 5,984,812 | A * | 11/1999 | Sassak | 473/596 |
| 6,283,881 | B1 * | 9/2001 | Feeney | 473/596 |
| 6,685,584 | B2 * | 2/2004 | Jin et al. | 473/596 |
| 7,566,488 | B2 * | 7/2009 | Mimura et al. | 428/151 |
| 7,758,458 | B2 * | 7/2010 | Fujisawa et al. | 473/597 |
| 2004/0142780 | A1 * | 7/2004 | Estefano | 473/604 |
| 2004/0185245 | A1 * | 9/2004 | Akamata et al. | 428/323 |
| 2005/0058794 | A1 * | 3/2005 | Fujisawa et al. | 428/35.7 |
| 2006/0105866 | A1 * | 5/2006 | Ma | 473/603 |
| 2006/0199686 | A1 * | 9/2006 | Mimura et al. | 473/605 |
| 2007/0117662 | A1 * | 5/2007 | Ma | 473/604 |
| 2007/0219028 | A1 * | 9/2007 | Fujisawa et al. | 473/596 |

FOREIGN PATENT DOCUMENTS

| | | |
|---|---|---|
| JP | 11 93081 | 4/1999 |
| JP | 2000 102629 | 4/2000 |
| JP | 2005 2533 | 1/2005 |
| JP | 2005 87315 | 4/2005 |
| WO | 2005 097268 | 10/2005 |
| WO | WO 2005/097269 A1 | 10/2005 |

* cited by examiner

SHEET-LIKE OBJECT FOR BALL AND BALL

TECHNICAL FIELD

The present invention relates to a ball for any one of volleyball and beach volleyball. The present invention more specifically relates to a ball suitably used for volleyball and beach volleyball, which has not only excellent three-dimensional shape but also sufficient surface abrasion resistance, excellent cushioning property, and controllability at the time of tossing the ball, and a sheet-like material suitably used for such a ball.

BACKGROUND ART

Various properties are required for a ball such as volleyball and beach volleyball. For example, surface abrasion resistance at high level is required for a surface material subjected to repeated rubbing or collision with the ground, a floor, or the like. Further, in a case where a ball is controlled directly with a hand, soft cushioning property and controllability are required for reducing impact on fingertips and/or arms in touching the ball. Further, in recent years, even when the surface of a ball gets wet with perspiration, favorable controllability is demanded in many cases.

Various methods have been hitherto proposed as a method for obtaining a ball having surface abrasion resistance and cushioning property at high level, and also having leather-like appearance and texture in terms of inclination.

For example, there are proposed: a leather-like sheet at least including 4 layers of a nonporous elastic polymer layer (first layer), a porous elastic polymer layer (second layer), a layer formed of an elastic polymer and a nonwoven fabric (third layer), and a nonwoven fabric layer (fourth layer); and a ball formed of the leather-like sheet (see Patent Document 1). However, in a method of Patent Document 1, the first and second layers are formed by using elastic polymers each having durability for practical use to provide a ball which has insufficient cushioning property and which is not satisfactory in controllability and flight performance of a ball.

Further, as a leather-like sheet having an excellent three-dimensional shape in addition to cushioning property, there is proposed: a synthetic leather having a transparent nonporous layer containing polyurethane as a main ingredient laminated on a surface of a fibrous base material covered with a polyurethane layer and having a pattern of pebbles and valleys; the synthetic leather has an air layer between the valleys and the nonporous layer; and a total area of bonding parts between the pebbles and the nonporous layer accounts for 50 to 90% of a surface area of the synthetic leather (see Patent Document 2). However, even in Patent Document 2, a ball used as a ball handled with hand(s), such as volleyball or beach volleyball, while having both cushioning property and durability for practical use has not yet been obtained, and the controllability and flight performance of the ball is not satisfactory.

In addition, there is proposed a ball having substantially continuous pebbles and valleys adjoining the pebbles formed on the surface, in which: a height difference between the pebbles and the valleys is 50 to 1,000 μm; a vertical projected area of each of the adjoining valleys is 3 to 30 $mm^2$; an average distance between the valleys is 0.5 to 3 mm; and a total area of the vertical projected areas of the valleys accounts for 30 to 60% of a surface area of a sheet (see Patent Document 3). Such a ball is suitable as a ball caught by a hand, such as a basketball. However, as a ball hit with hand(s) such as volleyball, the impact at the time of hitting the ball, controllability, and flight performance of the ball are not satisfactory.

In addition, there is proposed a basketball which can demonstrate an excellent non-slip property even when it gets wet, due to secondary pebbles and valleys formed on the top surface of primary pebbles so that the minute pebbles and valleys of the fingerprints of hand(s) holding a ball engage with the ball (see Patent Document 4). Such a ball is suitable as a ball caught by hand(s), such as a basketball. However, as a ball hit with hand(s), such as volleyball, the impact at the time of hitting the ball, controllability, and flight performance of the ball are not satisfactory.

Patent Document 1: JP 2000-102629 A
Patent Document 2: JP 11-93081 A
Patent Document 3: WO 2005/97268 A
Patent Document 4: JP 2005-87315 A

DISCLOSURE OF THE INVENTION

Problems to be Solved by the Invention

Under the above-mentioned circumstances, the present invention aims to provide a ball which has sufficient surface abrasion resistance, soft cushioning property, excellent controllability, and flight performance as a surface material of a ball for ball games while having an excellent three-dimensional shape and which can be used suitably as a volleyball and beach volleyball. The present invention also aims to provide a sheet-like ball material which can be used suitably for the same.

Means for Solving the Problems

The inventors of the present invention carried out extensive studies for attaining the above-mentioned object, and have found that the object can be attained by forming valleys discontinuously at short intervals for providing substantially continuous pebbles on the surface of a sheet-like material used for forming a ball. The present invention has been accomplished based on this finding.

In other words, the present invention provides a sheet-like ball material including: a fibrous base material; and an elastic polymer cover layer 1 that is laminated on a surface of the fibrous base material, in which: continuous pebbles 4 and discontinuous valleys 3 are formed on a surface elastic polymer of the cover layer; the valleys 3 are formed at average intervals of 0.5 to 3 mm; the valley 3 has a depth of 50 to 500 μm; a vertical projected area of each valley 3 is 1 to 5 $mm^2$; a total area of the vertical projected area of each valley 3 accounts for 3 to 30% relative to a surface area of the elastic polymer cover layer; and a ball used for volleyball or beach volleyball including the sheet-like material.

Effects of the Invention

The ball of the invention has substantially continuous pebbles on the surface of a sheet-like material used for forming a ball by forming valleys discontinuously at short intervals. Therefore, due to sufficient surface abrasion resistance and an excellent cushioning property of the substantially continuous pebbles, the impact applied to fingertips and arms at the time of hitting the ball can be reduced. The valleys not only impart a stable flight performance but also improve the controllability of the ball due to increased contact area and contact time between the fingertips and the ball surface. Further, the ball has a non-slip property that resists slipping even when the ball gets wet with perspiration or water.

Thus, the ball of the present invention has excellent controllability for all types of ball plays, i.e., tossing, attacking, and serving.

DESCRIPTION OF REFERENCE SYMBOLS

Figure 1:
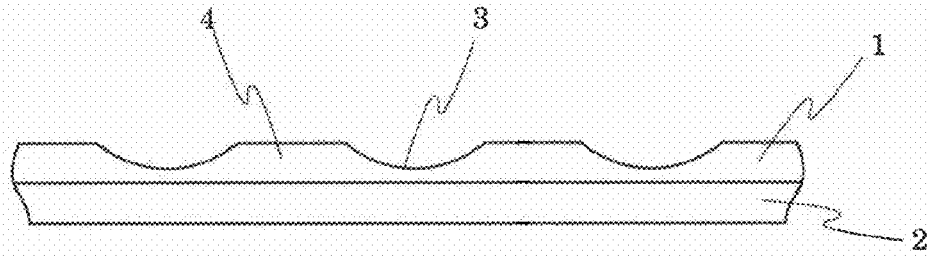
FIG. 1 is a cross-sectional schematic diagram illustrating an example (straight line showing a pebble) of pebbles and valleys of a sheet-like material for use in the ball of the present invention.

1: cover layer
2: fibrous base material
3: valleys
4: pebbles
5: secondary valleys
6: secondary pebbles
D: depth of a valley (distance)
B: boundary between the valley and a flat portion
X: vertical projected area of a valley

BEST MODE FOR CARRYING OUT THE INVENTION

A sheet-like material for forming the ball of the present invention is provided by a sheet-like material which is composed of a fibrous base material and an elastic polymer cover layer and which has numerous continuous pebbles and discontinuous valleys formed on the surface of the cover layer. Here, the phrase "discontinuous valleys" refers to numerous mutually independent depressed shapes (valleys) that are formed by pressing, to a flat sheet surface, for example, under pressure a plurality of mutually independent protruded shapes that are placed at intervals.

A method of forming "discontinuous valleys" may employ any known method insofar as the desired pattern of valleys can be provided stably. For example, employable is a method involving embossing of a surface of a sheet-like material whose at least surface layer is formed of an elastic polymer by using an emboss roller or the like having a desired pattern of pebbles; or a method involving formation of an elastic polymer cover layer by casting and solidifying an elastic polymer liquid on a released paper having a desired pattern of valleys, and use of the elastic polymer cover layer as a surface layer for the sheet-like material.

It is necessary for each valley to have a vertical projected area of 1 to 5 $mm^2$, an average distance between the adjoining valleys of 0.5 to 3 mm, and the depth of the valleys of 50 to 500 μm. As a method of forming the discontinuous valleys within the above-mentioned range, the method using a released paper among the above-mentioned methods has a limit in the depth of valleys of a sheet-like material to be obtained in view of manufacturing of the released paper to be used. In addition, in the case where a resin solution is applied to a released paper having discontinuous pebbles, there is a tendency that bubbles form in the vicinity of the pebbles when the depth of the pebbles (valleys in the sheet-like material) is deeper. Thus, such a method is suitable for a case where the intended depth of the valley is less than 150 μm as a standard. In contrast, in the method involving embossing by using an emboss roller or the like, an emboss roller having a pattern of pebbles whose depth corresponds to that of the intended valleys may be used. The properties do not depend on the intended depth. Therefore, considering industrial productivity, the method of forming patterns with an embossing roller or the like is more preferable than the method using a released paper.

When desired valleys are formed by using an emboss roller, conditions such as pebble height of the roller to be used, a roller temperature, an embossing pressure, and embossing time may be arbitrarily set. The conditions are not particularly limited, but the desired valley depth may be obtained by adjusting: the pebble height of the roller within the range of 80 to 700 μm; the roller temperature within the range of 150 to 180° C.; the embossing pressure within the range of 5 to 50 kg/cm; and the embossing time within the range of 10 to 120 seconds.

A ball according to the present invention, that is, a ball to be used in ball games such as volleyball and beach volleyball in which a ball is hit by hand is generally produced by sewing together a plurality of pieces formed of natural leather, synthetic leather, or the like, or by attaching together a plurality of pieces to a core material of the ball. Here, parts where outer peripheries of the individual pieces are brought into contact with each other form streaks or seams. However, the pebbles and valleys on the surface of the sheet-like material in the present invention refer to not streaks or seams formed on peripheries of the pieces, but patterns formed on surfaces of the pieces. The pebbles and valleys include no gas filling port generally present on a surface of a gas filling-type ball, nor logos locally formed on the surface of the ball.

As a shape of the surface of a ball for use in ball games such as volleyball, it is necessary that when a player catch a ball at random, at least one of valleys contacts the fingertips of the player. Therefore, as the shape of the ball surface, the depth of the valley is 50 to 500 μm, and preferably 200 to 350 μm. In the case where the depth of the valley is less than 50 μm, such a ball is likely to slip when it gets wet with perspiration or water. Thus, an effect of controlling the ball is not acquired at the time of, in particular, tossing the ball, and moreover it is difficult to suppress deviation in the trajectory of the ball during flight when serving or the like. Further, the design effect will also become small from the viewpoint of marketability. In contrast, when the depth of the valley exceeds 350 μm, there is a tendency that the non-slip property when a ball gets wet with perspiration or water is further improved and the controllability is further improved at the time of tossing a ball. However, some players feel uncomfortable due to fingertip traction of the ball. When the depth of the valley exceeds 500 μm, a large majority of players are bothered by excessive finger traction rather than improvement in the controllability at the time of tossing the ball. Thus, the tendency that the evaluation for the controllability of the ball is lowered for all types of ball plays becomes remarkable.

Figure 3:
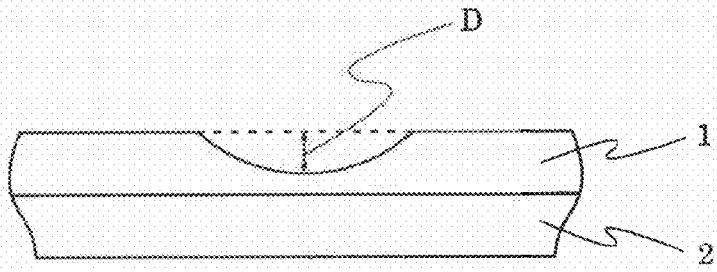
FIG. 3 is a cross-sectional schematic diagram illustrating the depth (distance: D) of a valley of pebbles and valleys of the sheet-like material for use in the ball of the present invention.

The phrase "the depth of the valley" used in the present invention refers, as shown in FIG. 3, to a value obtained by, measuring a distance (D) from the surface of a pebble to the deepest part of a valley in a cover layer using a cross-sectional photograph in the thickness direction, and averaging the measurement values of ten measurement points.

Figure 4:
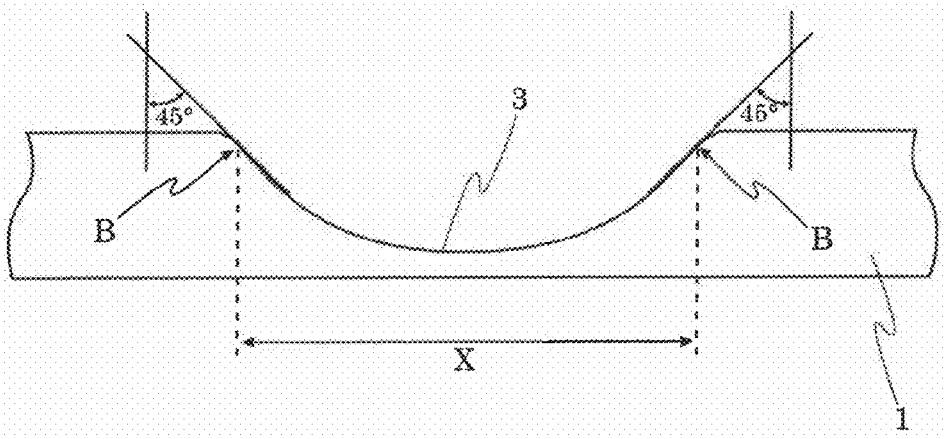
FIG. 4 is a cross-sectional schematic diagram illustrating a boundary (B) between the valley whose cross-section is a hemispherical shape and a flat portion in the sheet-like material for use in the ball of the present invention.
Figure 5:
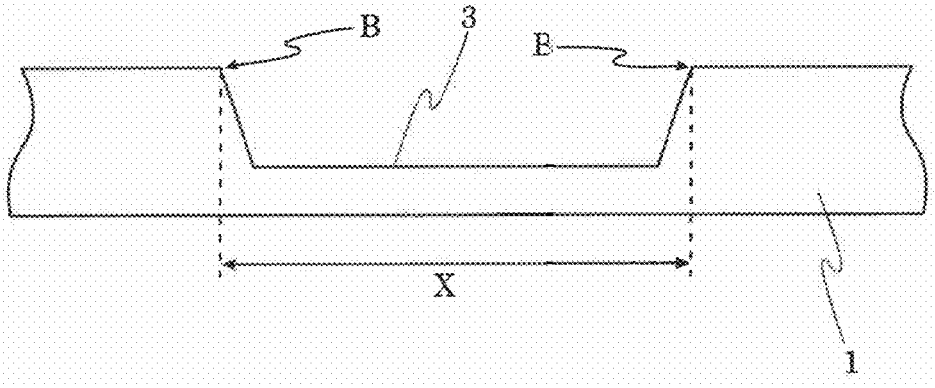
FIG. 5 is a cross-sectional schematic diagram illustrating a boundary (B) between the valley whose cross-section is a trapezoidal shape and a flat portion in the sheet-like material for use in the ball of the present invention.

A vertical projected area of each of the valleys of the sheet-like material to be used in the present invention needs to be 1 to 5 $mm^2$, and preferably 2 to 3 $mm^2$. When the vertical projection area exceeds 5 $mm^2$ and each valley becomes large, there is a tendency that a large majority of players evaluate that the fingertip traction of the ball is too strong. Thus, the tendency that the evaluation for the controllability of the ball is lowered for all types of ball plays becomes remarkable. In addition, an adverse effect that the abrasion property of the ball is also lowered is revealed. When the vertical projected area is less than 1 $mm^2$, the finger traction is almost lost, an effect of controlling the ball at the time of tossing the ball is hardly acquired because the ball is likely to slip also when it gets wet with perspiration or water, and an effect of inhibiting deviation of the trajectory of the ball during flight at the time of serving the ball or the like is not acquired. Further, the design effect will also become small from the viewpoint of marketability. In the cross section passing through the deepest part of valleys of a sheet-like material, when the surfaces of valleys and the surfaces of pebbles adjoining thereto are connected with a continuous curve, a portion where an angle defined by a tangent of the perpendicular of a flat part and the surface of valley is 45° is defined as a boundary (B) between a pebble and a valley (see FIG. 4). In contrast, when a fold is observed in a shape of the surface, the fold point is defined as a boundary (B) of a valley and a flat portion (see FIG. 5). A projected area in the vertical direction relative to the surface of a cover layer of a valley region surrounded by the boundary is referred to as a "vertical projected area of valley".

A total area of the vertical projected area of each valley accounts for 3 to 30%, preferably 10 to 25%, relative to the entire surface area of the cover layer. When a total area of the vertical projected area of each valley is less than 3%, the controllability at the time of tossing the ball is hardly improved, and moreover an effect of inhibiting deviation of the trajectory of the ball during flight of the ball at the time of serving or the like is not acquired. Further, the design effect will also become small from the viewpoint of marketability. In contrast, in the case where the proportion exceeds 30%, a favorable evaluation result can be obtained only from the viewpoint of a non-slip property, when the ball gets wet with perspiration or water. However, there is a tendency that a large majority of players evaluate that the fingertip traction of the ball at the time of tossing the ball is too strong, and thus, the tendency that the evaluation for the controllability of the ball is lowered for all types of ball plays becomes remarkable. Further, it is preferable that the sectional shape of the valley in the thickness direction be an arc shape, hemispherical shape, or trapezoidal shape, and it is preferable that the three-dimensional shape be a hemispherical shape, truncated cone shape, or truncated pyramid shape. Here, the term "hemispherical" refers not to a perfect hemispherical shape, but refers to a substantially hemispherical shape. Also the term "trapezoidal shape" refers not to a perfect trapezoidal shape, but refers to a substantially trapezoidal shape, and, for example, the base is not a straight line and may be a slightly convex. The same applies to an arc shape, hemispherical shape, truncated cone shape, and a truncated pyramid shape. When the shape of the valley is formed into a hemispherical shape, truncated cone shape, or a truncated pyramid shape, not only that very subtle fingertip traction can be acquired at the time of tossing the ball, but also that the controllability for all types of plays such as serving and other plays can be obtained with favorable balance.

Further, the average distance between the hemispherical valleys of a sheet-like material to be used in the present invention must be 0.5 to 3 mm. When the average distance is less than 0.5 mm, softness, cushioning property, feel, and surface abrasion resistance may deteriorate because the valleys are too close to each other, which provides a partly excessively sharp pebble pattern. When the average distance exceeds 3 mm, fitting property and non-slip property may deteriorate. The average distance between the valleys is preferably 1 to 2 mm.

The phrase "average distance between the valleys" refers to an average of values obtained by: photographing the surface with an electron microscope; selecting arbitrary 10 valleys; and measuring the shortest distance between the adjacent valleys from outer periphery of the valleys. A boundary between a pebble and a valley refers to a part at an angle of 45° to a normal of the sheet surface if the pattern is all curved as described above, or refers to a corner or angle if the pattern has corners or angles, and the part surrounded by the boundaries refers to outer periphery.

Figure 6:
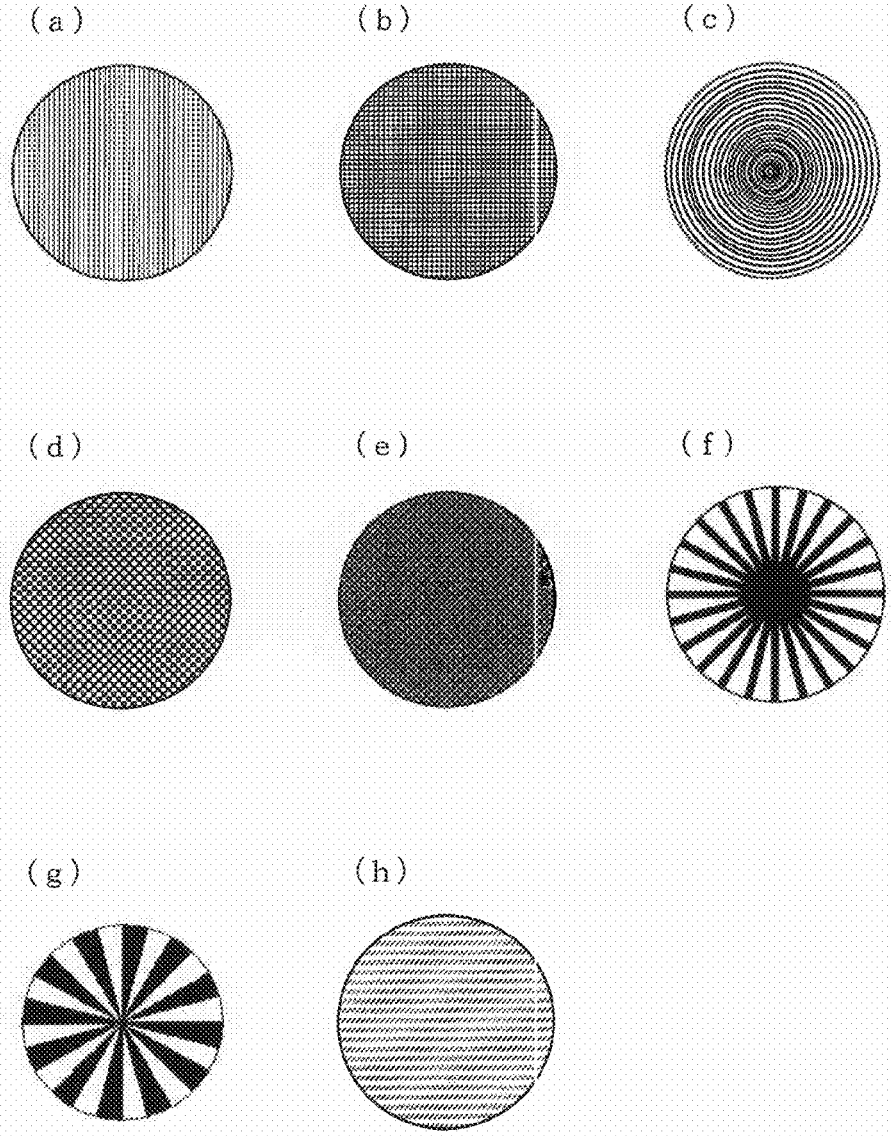
FIG. 6 are plan schematic diagrams illustrating an example (filled portion showing a valley of secondary pebbles and valleys) of the secondary pebbles and valleys of the sheet-like material of the present invention.

It is preferable that a sheet-like material for forming the ball of the present invention have, on the surface of a cover layer, secondary pebbles and valleys whose depths are less than those of the above-mentioned valleys (primary valley) and 10 to 100 μm. There is no limitation on the arrangement of the secondary pebbles and valleys. However, in order to uniformly obtain a non-slip property in all directions, an arrangement, in which pebbles and valleys are arranged on straight lines and curved lines in two or more directions, such as, a lattice-like arrangement, a concentric circle-like arrangement, and a radiation-like arrangement (see FIG. 6); an uneven shape formed of two or more straight lines and curved lines; a discontinuous valley shape which is the same as that of the primary valley; or a combination of the above.

It is preferable that the discontinuous valley shape which is the same as the primary valley shape be defined as a shape of the secondary valley because such a shape is excellent in a grip property, when the ball gets wet with perspiration, and in the design.

It is preferable that the depth of the secondary valley be within the range of 10 to 100 μm, and is less than the depth of the primary valley. It is more preferable that the depth of the secondary valley be within the range of 20 to 70 μm. When the depth of the secondary valley is adjusted to be 10 μm or more, sufficient fingertip traction is attained and the controllability at the time of tossing the ball is excellent. When the depth of the secondary valley is adjusted to be 100 μm or less, the abrasion resistance and/or the surface texture are excellent. Further, when the depth of the secondary valley is adjusted to be less than the depth of the valley, the abrasion resistance and/or the surface texture are excellent and also adhesion of a soil can be inhibited.

Figure 2:
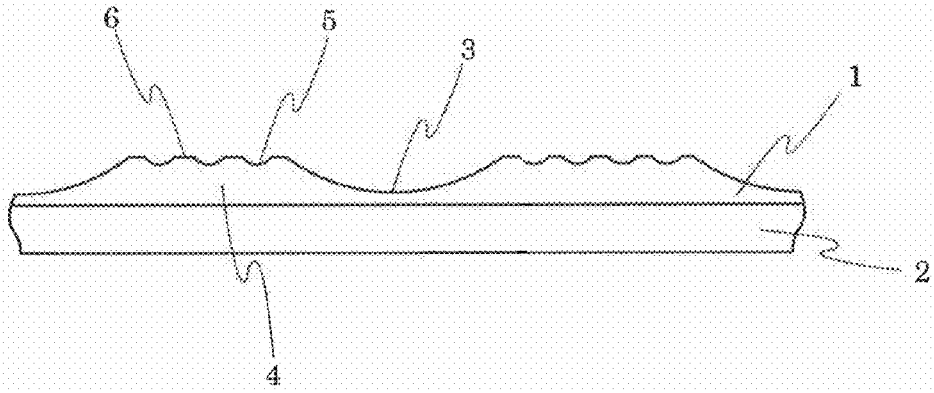
FIG. 2 is a cross-sectional schematic diagram illustrating an example (straight line showing a pebble of a secondary pebble) of secondary pebbles and valleys of the sheet-like material for use in the ball of the present invention.

Moreover, it is preferable that the secondary pebbles and valleys be further formed on portions other than the primary valleys of the surface of a cover layer, especially on the primary pebbles because the surface texture, controllability at the time of tossing the ball, straight line stability at the time of serving the ball, and antifouling property of the ball are provided. Further, when the secondary pebbles and valleys are formed on portions other than the valleys, the secondary pebbles and valleys may be formed on the side(s) and the top surface of each pebble. However, in the present invention, as shown in FIG. 2, the secondary pebbles and valleys are preferably formed on the top surface of each pebble.

Moreover, it is preferable that the secondary valley be discontinuous in such a manner that a vertical projected area be 0.01 to 1 $mm^2$ and a total area of the vertical projected area of each secondary valley account for 1 to 30% relative to the surface area of the cover layer.

It is preferable that a vertical projected area of the secondary valley be 0.01 to 1 $mm^2$ because a smooth surface texture is obtained. When the secondary valleys are formed of discontinuous valleys in which a total area of the vertical projected area of each secondary valley accounts for 1 to 30%, the fingertips are likely to be sufficiently engaged with the ball, whereby more excellent non-slip property can be attained. Moreover, it is more preferable that a vertical projected area of the secondary valley be 3 to 20% because the straight line stability of the ball is more excellent and the trajectory of a served ball with a long flight distance is less likely to deviate.

In the sheet-like material used in the present invention, a method of forming secondary pebbles and valleys on the surface of a cover layer on which discontinuous valleys are formed includes: a method of simultaneously forming valleys and secondary pebbles and valleys using a released paper capable of forming valleys and secondary pebbles and valleys; a method of transferring shapes of the secondary pebbles and valleys by pressing by an embossing treatment; and the like. Considering industrial productivity, the method of forming patterns by using an emboss roller or the like is more preferable than the method using a released paper.

When the intended secondary pebbles and valleys are formed by using an emboss roller, the pebbles may be formed by arbitrarily setting conditions such as a convex depth of the emboss roller to be used, an emboss roller temperature, an embossing pressure, and embossing time. The conditions are not particularly limited, but the intended secondary pebbles and valleys are formed by adjusting: the emboss depth of the roller within a range of 80 to 700 μm; the roller temperature within the range of 150 to 180° C.; the embossing pressure within the range of 5 to 50 kg/cm; and the embossing time within the range of 10 to 120 seconds.

It is economically preferable to produce in advance and use an emboss roller with a shape capable of forming discontinuous valleys and secondary pebbles and valleys so that discontinuous valleys and secondary pebbles and valleys can be simultaneously formed by one embossing treatment.

Coloring treatment may be performed before or after the process for forming valleys and/or secondary pebbles and valleys. For example, shapes are imparted by using an emboss roller, coloring treatment can be performed before or after the embossing treatment. However in many cases, the embossing treatment involves a heating treatment, which may cause discoloration. Thus, in consideration of possible discoloration during the embossing treatment, the coloring treatment is preferably performed before the embossing treatment so as to prevent discoloration due to a heat treatment. Pigments are most preferably used as colorants from the viewpoints of heat resistance, light resistance, and fastness to rubbing. The coloring treatment may be performed through methods such as a gravure method, a dyeing method, a reverse coating method, and a direct coating method. The coloring treatment is most preferably performed through a gravure method from the viewpoints of productivity, cost, and the like.

The thickness of the elastic polymer cover layer to be used in the present invention can be arbitrarily selected depending on essential physical properties or texture which is preferred by a player. The thickness of the elastic polymer cover layer of the present invention is not limited, but is preferably 0.1 to 0.3 mm. When the thickness of the elastic polymer cover layer is 0.1 mm or more, minimum essential mechanical properties such as abrasion resistance, and the like can be ensured. In contrast, when the thickness of the elastic polymer cover layer is 0.3 mm or less, the weight of a ball is not adversely affected.

In the present invention, the surface touch can be changed, and water repellency, antifouling property, and the like can be given, as required. For example, the following methods of: applying resin of a touch modifier to at least one part of the discontinuous valleys or a flat portion; and applying a pharmaceutical drug which has a fluorine resin as a main component are mentioned. Examples of the resin of a touch modifier include: a resin including polyurethane resin as a main component; a resin obtained by modifying a polyurethane resin; a resin including an amino acid resin as a main component; and a resin utilizing collagen powder, silk powder, and the like, and any of the above can be used according to the intended purpose.

Various methods may be used for a method for covering the flat portion of the surface of the sheet-like material with resin or a pharmaceutical drug. In particular, in a case where only the flat portion is covered with a non-slip resin, a method involving selective application of the non-slip resin is suitably used. A specific example thereof is a method involving transfer of a non-slip resin by using a gravure roller. Not only the flat portion but also the valleys are covered with a non-slip resin through a method involving application of the non-slip resin over the entire surface. Specific examples thereof include: a method involving application of a non-slip resin through spray coating; a method involving coating of a non-slip resin at a constant thickness over the entire surface through knife coating or the like; a method involving application of a non-slip resin over the entire surface of a base material such as process paper for film formation and bonding of the film onto a base material layer through an adhesive layer; and a method involving uniform extrusion of a non-slip resin over a base material from an extruder through an extrusion die for film formation on the surface thereof.

Examples of the fibrous base material which can be used for the sheet-like material forming a ball of the present invention include various fibrous base materials such as natural leather, leather-like sheet, knitted woven fabric, and nonwoven fabric. When the knitted woven fabric, nonwoven fabric, or the like is used as a fibrous base material, the fibrous base material may be impregnated with a polymer as required. Any known leather-like sheets may be used as the fibrous base material. Of those, a leather-like fibrous base material formed of a fiber-entangled fabric and a polymer is preferred, and a fibrous base material having a three-dimensionally entangled nonwoven fabric used as a fiber-entangled fabric which is impregnated with a spongy polymer is particularly preferred. This is because the substantially continuous pebbles resulting from the valleys on the surface of the sheet-like material fit well with the fingertips grasping a ball, the sheet surface has soft touch and texture, and certain degree of cushioning property, to thereby improve the non-slip property.

Any known natural fiber, synthetic fiber, or semisynthetic fiber may be used for a fiber constituting the knitted woven fabric, nonwoven fabric, or the like as the fibrous base material, as long as mechanical properties required for a surface material of a ball can be satisfied. Industrially known cellulose-based fiber, acrylic fiber, polyester-based fiber, polyamide-based fiber, or a mixture thereof is preferably used from the viewpoints of quality stability, cost, and the like. In the present invention, though not particularly limited, a microfine fiber capable of realizing a soft texture similar to that of natural leather is preferred. A microfine fiber having an average fineness of 0.3 dtex or less, particularly 0.1 dtex or less and 0.0001 dtex or more is preferably used.

Examples of a method of forming the microfine fibers described above include: (a) a method involving direct spinning of microfine fibers having an intended average fineness; and (b) a method involving spinning of microfine fiber-forming fibers having a fineness larger than the intended fineness, and then converting the microfine fiber-forming fibers into microfine fibers having the intended average fineness.

In the method (b) of forming microfine fibers by way of microfine fiber-forming fibers, the microfine fibers are generally formed by composite spinning or mix spinning two or more types of incompatible thermoplastic polymers. Then, at least one polymer component of the fibers is removed through extraction or decomposition, or polymers are segmented or split along a boundary between the component polymers. Examples of the microfine fiber-forming fibers from which at least one polymer component is removed include so-called "sea/island fibers" and "multi-layered fibers".

In the sea/island fibers, a sea component polymer is removed through extraction or decomposition, and in the multi-layered fibers, at least one layer component polymer is removed through extraction or decomposition, to thereby obtain microfine fiber bundles formed of the remaining island component. Typical examples of the microfine fiber-forming fibers segmented or split along the boundary between the component polymers include so-called petal-like layered fibers and multi-layered fibers, which are split from each other along the boundary between layers of different polymers into microfine fiber bundles through physical treatment or chemical treatment.

The island component polymer for the sea/island fibers or multi-layered fibers is preferably a polymer which can be subjected to melt spinning and is capable of exhibiting sufficient fiber physical properties such as strength. The island component polymer preferably has, under spinning conditions, a higher melt viscosity than that of the sea component polymer and large surface tension. Examples of the island component polymer described above include: polyamide-based polymers such as nylon-6, nylon-66, nylon-610, and nylon-612; polyamide-based copolymers thereof; polyester-based polymers such as polyethylene terephthalate, polypropylene terephthalate, polytrimethylene terephthalate, and polybutylene terephthalate; and polyester-based copolymers thereof.

The sea component polymer for the sea/island fibers or multi-layered fibers is preferably a polymer which has lower melt viscosity than that of the island component polymer, exhibits dissolution and decomposition behaviors different from those of the island component, has high solubility in a solvent, a decomposer, or the like used for dissolving or removing the sea component, and has a low compatibility with the island component. Examples of the sea component polymer suitably used include polyethylene, modified polyethylene, polypropylene, polystyrene, modified polystyrene, and modified polyester.

Microfine fiber-forming fibers for suitably forming microfine fibers having a fineness of 0.3 dtex or less, that is, the sea/island fibers have a suitable sea/island volume ratio of 30/70 to 70/30, and preferably 40/60 to 60/40. When the volume ratio of the sea component is 30% or higher, a leather-like sheet to be obtained is sufficiently flexible because the component to be removed through dissolution or decomposition by using a solvent or decomposer is enough, which eliminates the necessity of using a treating agent such as a softening agent in an excess amount. However, the use of an excess amount of the treating agent is not preferable because it may cause various problems such as deterioration in mechanical properties such as tear strength, adverse effects on other treating agents, adverse effects on touch, and durability deterioration. When the volume ratio of the sea component is 70% or less, a leather-like sheet to be obtained can stably ensure mechanical properties at a sufficient level for a base material for a ball material because the absolute amount of the fibers formed of the island component obtained after removal through dissolution or decomposition is enough. In addition, the amount of the component to be removed through dissolution or decomposition is not too large, resulting in no problems such as variation in quality due to removal failure and disposal of removed components in large amounts, and further, it is appropriate from the viewpoint of productivity with respect to production rate, production cost, or the like, and thus is industrially desirable.

In addition, a method of producing the three-dimensionally entangled nonwoven fabric suitably used as a fiber-entangled fabric is not particularly limited, and the three-dimensionally entangled nonwoven fabric can be produced through any known method providing appropriate weight or density for a base material for a ball material. Examples of the fabric to be used include: nonwoven fabric formed of staples; and nonwoven fabric formed of filaments. A method of forming a web may employ any known methods such as carding, papermaking, and spun-bonding. The web can be entangled through a known method such as needle-punching or spunlacing alone or in combination.

Of the methods, the three-dimensionally entangled nonwoven fabric is particularly preferably produced by the following method. Spun fibers are drawn at a draw ratio of about 1.5 to 5 times, mechanically crimped, and then cut into staples about 3 to 7 cm long each. The staples are then carded and passed through a webber to form a web having a desired density. The obtained web is laminated to have a desired weight, and then needle-punched at about 300 to 4,000 punches/cm$^2$ by using a single- or multi-barb needle to entangle the fibers in a thickness direction.

Next, the obtained fiber-entangled fabric such as the three-dimensionally entangled nonwoven fabric is impregnated with a polymer as required. The fiber-entangled fabric is impregnated with a solution or dispersion of the polymer through any known method such as dip-nipping, knife-coating, bar-coating, roll-coating, and spray-coating alone or in combination, and then the polymer is dry- or wet-coagulated into a spongy form having numerous voids.

Any known polymers generally used for production of a leather-like sheet may be used as the polymer in the present invention. Preferable examples of the polymer include a polyurethane-based resin, a polyester-based elastomer, a rubber-based resin, a polyvinyl chloride resin, a polyacrylic acid-based resin, a polyamino acid-based resin, a silicon-based resin, modified products thereof, copolymers thereof, and mixtures thereof.

The polymer in an aqueous dispersion or organic solution is impregnated into the fiber-entangled fabric, and is formed into a spongy form mainly through dry-coagulation for the aqueous dispersion or through wet-coagulation for the organic solution. When the aqueous dispersion is used, a heat-sensitive gelling agent can be preferably added, to thereby allow uniform coagulation of the polymer in a thickness direction through dry-coagulation, or through dry-coagulation combined with steaming, far infrared heating, or the like. When the organic solution is used, a coagulation modifier can be preferably used in combination, to thereby form more uniform voids. The polymer impregnated into the fiber-entangled fabric, especially into the three-dimensionally entangled nonwoven fabric, can be coagulated into a spongy form to thereby obtain a base material having a natural leather-like texture and various physical properties suitable for a material for a ball.

In the present invention, a polyurethane-based resin is preferably used as the polymer impregnated into the fiber-entangled fabric from the viewpoints of a texture and well-balanced physical properties of the resulting fiber-entangled fabric in a composite state.

Typical examples of the polyurethane-based resin are those produced through reaction in a predetermined molar ratio of: at least one polymer diol having an average molecular weight of 500 to 3,000 selected from the group consisting of polyester diol, polyether diol, polyester ether diol, polylactone diol, and polycarbonate diol; at least one organic diisocyanate selected from the group consisting of aromatic, alicyclic, and aliphatic organic diisocyanates such as tolylenediisocyanate, xylylenediisocyanate, phenylene diisocyanate, 4,4'-diphenylmethane diisocyanate, 4,4'-dicyclohexylmethane diisocyanate, isophorone diisocyanate, and hexamethylene diisocyanate; and at least one chain extender selected from the group consisting of low molecular compounds having at least two active hydrogen atoms such as diols, diamines, hydroxylamines, hydrazines, and hydrazides. Polyurethane may be used as a mixture of two or more types thereof, or may be used as a polymer composition obtained by adding a polymer such as synthetic rubber, polyester elastomer, or polyvinyl chloride as required.

When the microfine fiber-forming fibers are used as the fiber, a composite sheet obtained after impregnation and coagulation of the solution or dispersion of the polymer, or a fiber sheet before impregnation and coagulation of the solution or dispersion of the polymer is subjected to microfine fiber formation. Thus, the microfine fiber-forming fibers are converted into microfine fiber bundles to thereby obtain a leather-like fibrous base material formed of the microfine fiber-entangled fabric and the polymer. When the composite sheet, in particular, the sea/island fiber is subjected to microfine fiber formation, the sea component polymer is removed to form voids between microfine fiber bundles and the polymer to weaken the binding of the microfine fiber bundles by the polymer. Thus, the leather-like fibrous base material tends to have a softer texture. Therefore, this method can be preferably employed in the present invention.

On the other hand, when the fiber sheet is subjected to microfine fiber formation, the microfine fiber bundles are strongly bound by the polymer and the leather-like fibrous base material tends to have a harder texture. However, the tendency of having a harder texture can be sufficiently suppressed by reducing the ratio of the polymer in the leather-like fibrous base material. Therefore, this method is preferred for obtaining dense and hard texture with a higher ratio of fibers.

The thickness of the fibrous base material to be used in the present invention may be arbitrarily selected in accordance with the intended use. For example, in the case of a surface material of a ball, the thickness of the fibrous base material to be used in the present invention may be arbitrarily selected in accordance with the type or required physical properties of the ball, the texture of the ball preferred by a player, and the like. The thickness thereof is preferably 0.4 to 3.0 mm, although not particularly limited thereto. When the thickness of the fibrous base material is 0.4 mm or more, the fibrous base material used as a cover material of handgrip such as various rackets, handles, and handrails as well as a material for a ball can ensure minimum essential mechanical properties such as tensile strength, tear strength, or abrasion resistance. In contrast, when the thickness of the fibrous base material is 3.0 mm or less, the weight of a product itself employing the sheet-like material such as a ball, racket, handle, and the like is not adversely affected.

The mass ratio of the fibers to the polymer in the fibrous base material may be arbitrarily selected for adjusting physical properties or texture, and is not particularly limited in the essential significance of the present invention. For example, a fibrous base material having a generally preferred leather-like texture as a material for a ball has a mass ratio of fibers/polymer of 35/65 to 65/35, preferably 40/60 to 60/40 when the composite sheet is subjected to microfine fiber formation, or a mass ratio thereof of 65/35 to 95/5, preferably 60/40 to 90/10 when the fiber sheet is subjected to microfine fiber formation.

Various methods can be employed for covering the surface of the fibrous base material with an elastic polymer. An example of the method includes: continuous application of a dispersion, solution, or melt of the elastic polymer onto a surface of a fibrous base material in an amount regulated by a predetermined clearance between the surface of the fibrous base material and a knife, bar, roller, or the like; and drying of the elastic polymer into a film form or dry-coagulation and drying of the elastic polymer into a porous form, wet-coagulation and drying of the elastic polymer into a porous form, or forming a cover layer formed of an elastic polymer on the surface of the fibrous base material through melt formation.

When the fibrous base material formed of a fiber-entangled fabric and an elastic polymer is used as the fibrous base material, a method of simultaneously completing coagulation of the elastic polymer to be impregnated into the fibrous base material and coagulation of the elastic polymer for forming a cover layer is preferably employed in the present invention. Thus, the drying after the coagulation can be performed in one step, and the fibrous base material and the elastic polymer cover layer (porous surface layer) can be easily integrally bonded in the obtained leather-like sheet. Therefore, the method can be preferably employed in the present invention.

Another method of forming the elastic polymer cover layer on the surface of the fibrous base material includes: application of a predetermined amount of dispersion or solution of an elastic polymer on a transfer sheet such as a film or released paper once; drying of the elastic polymer into a film form, or coagulation and drying of the elastic polymer into a porous form in the same manner as described above; integrally bonding the obtained film to the fibrous base material through an adhesive, or through re-dissolution by using a treating liquid containing a solvent of the elastic polymer; and peeling off the transfer sheet. Still another method thereof involves: application of a predetermined amount of dispersion or solution of an elastic polymer onto a transfer sheet once; and attaching of the transfer sheet with a fibrous base material before or during the drying or coagulation of the elastic polymer, to thereby integrally bond the elastic polymer cover layer and the fibrous base material simultaneously with the coagulation.

The elastic polymer forming a cover layer is preferably a resin capable of providing non-slip property to some extent, not a resin having slip property as a resin itself. Examples of the resin that can be used include synthetic rubber, polyester elastomer, polyvinyl chloride, and a polyurethane-based resin. Of those, a polyurethane-based resin is preferably used as the elastic polymer forming the cover layer, as in the case with the elastic polymer impregnated into the fiber-entangled fabric, from the viewpoint of a balance among elasticity, softness, abrasion resistance, ability of forming a porous form, and the like.

Various polyurethane-based resins as described above may be used as the polyurethane-based resin. Polyurethane may be used as a mixture of two or more types thereof, or may be used as a polyurethane polymer composition obtained by adding a polymer such as synthetic rubber, polyester elastomer, or polyvinyl chloride as required. As polyurethane mainly used, a resin formed of polyether-based polymer diol represented by polytetramethylene glycol is preferably used from the viewpoints of hydrolysis resistance, elasticity, and the like.

When polyurethane is used as the elastic polymer, a solution containing polyurethane as a main ingredient is applied onto the fibrous base material and the whole is immersed in a treating bath containing a poor solvent of polyurethane, to thereby coagulate polyurethane into a porous form. Water is preferably used as a typical poor solvent of polyurethane. A good solvent of polyurethane such as dimethylformamide is mixed with water which is a poor solvent as a treating bath, and a mixing ratio thereof is arbitrarily set, to thereby allow control of a coagulated state, that is, a porous form or pattern and result in a preferably employed method.

To the solution or dispersion of the elastic polymer to be applied onto the fibrous base material, an additive such as a colorant, a light stabilizer, or a dispersant alone or in combination of two or more types thereof is added arbitrarily in accordance with the purpose. Other additives such as a coagulation modifier for wet-coagulation may be arbitrarily selected as required and preferably added alone or in combination of two or more types thereof to control the porous form, in addition to the foaming agent for dry foaming.

EXAMPLES

Next, the present invention will be described more specifically by way of examples, but the present invention is not limited to the examples. In the examples, "parts" and "%" represent "parts by mass" and "mass %" respectively, unless otherwise noted.

Abrasion resistance, cushioning property, and flight property (controllability) were evaluated as described below.

[Abrasion Resistance]

A ball of the present invention was thrown at plywood 1.6 m away at a launch rate of 37 km/hour and an angle of incidence of 600 for 20,000 times, and then a surface condition of the ball was observed and evaluated according to the following criteria.

Level causing no problems in practical use: no surface peel and no significant dirt observed.

Level causing problems in practical use: surface peel in a vicinity of an air filling port or ball surface observed, or significant dirt observed.

[Cushioning Property]

Whether impact in receiving a ball of the present invention is stronger or weaker compared with that a conventional volleyball (Comparative Example 1) was evaluated by 10 arbitrarily selected volleyball players.

[Controllability at the Time of Tossing]

In tossing the ball of the present invention, whether the ball flies to the intended position more successfully compared with that of a conventional volleyball (Comparative Example 1) was evaluated by 10 arbitrarily selected volleyball players.

[Controllability at the Time of Serving]

In serving the ball of the present invention, whether the ball flies to the intended position more successfully compared with that of a conventional volleyball (Comparative Example 1) was evaluated by 10 arbitrarily selected volleyball players.

[Smoothness of the Attenuation Degree in the Ball Speed During Flight of a Ball]

When a ball is sent out at an initial rate of about 50 km/hour and a striking angle of 15°, and the trajectory of the ball is photographed with a high-speed camera, if the attenuation degree in the ball speed (the trajectory of the ball's drop from the apex) is longer than that of a conventional ball, the attenuation degree in the ball speed during flight is said to be smooth.

Example 1

(1) Nylon-6 (island component) and high-fluidity low-density polyethylene (sea component) were melt-spun into sea/island mix-spun fibers (sea component/island component ratio=50/50). The obtained fibers were drawn, crimped, and then cut into 51 mm-long staples having a fineness of 3.5 dtex. The staples were carded and formed into a web through a cross-lapping method to be laminated. A stack of webs was needle-punched at a needling density 980 P/cm$^2$ by using single-barbed felt needles, to thereby obtain a nonwoven fabric having a mass per unit area of 450 g/m$^2$. The nonwoven fabric was dried under heating, pressed to smooth its surface, and impregnated with a 13% dimethylformamide (hereinafter, referred to as "DMF") solution of polyether-based polyurethane, followed by the coagulation of the impregnated polyurethane in an aqueous solution of DMF. Then, the nonwoven fabric was washed with hot water, and polyethylene in the fibers was extracted and removed by hot toluene, to thereby obtain a synthetic leather-like fibrous base material formed of nylon-6 microfine fibers and porous polyurethane.

A DMF solution (solid content: 20%) of polyether-based polyurethane (MP-145, available from Dainippon Ink & Chemicals, Inc.) was applied onto the surface of the artificial leather-like fibrous base material in an amount of 400 g/m$^2$ and coagulated in water, to thereby form an elastic polymer cover layer in a state of a porous surface layer. The elastic polymer cover layer was colored with an ether-based polyurethane ink containing a white pigment, and was embossed at a temperature of 170° C., a pressure of 10 kg/cm, and an emboss rate of 1 m/minute by using an emboss roller having pebbles of a truncated pyramid shape with a height of 0.5 mm and a vertical projected area of 4 mm$^2$. The obtained pattern of valleys had almost the same depths between the discontinuous pebbles, and an average depth of 260 μm. The obtained pattern had almost the same vertical projected areas of valleys, that is, vertical projected areas of valleys from the upper surfaces which are perpendicular to the sheet surface for any valley, and an average vertical projected area of 3 mm$^2$. Further, the obtained pattern of valleys had an average distance between the valleys of 2.0 mm, and the total area of the vertical projected areas of the valleys accounted for 19% of the surface area of the cover layer.

(3) A volleyball covered with the obtained sheet was produced, and the evaluation of the ball was performed by arbitrarily-selected 10 volleyball players. As a result, compared with a conventional volleyball (Comparative Example 1), the ball of the present invention had properties, which were not realized by heretofore existing balls, such that the ball of the present invention flew to the intended position both when tossing and when serving the ball, and moreover, the attenuation degree in the ball speed during flight of the ball was smooth compared with the conventional ball. Moreover, the ball had an abrasion resistance at a level causing no problems in practical use. Even if the ball was actually used for about six months, tears or significant cracks due to abrasion were not observed and favorable controllability was maintained. Moreover, with respect to the cushioning property of the ball of the present invention, the impact felt by a player at the fingertips and arms when receiving the ball was a satisfactory level.

Example 2

(1) The same procedure of Example 1 was followed except that embossing was performed at a temperature of 170° C., a pressure of 10 kg/cm, and an emboss rate of 1 m/minute by using an emboss roller having pebbles of a truncated pyramid shape with a height of 0.5 mm and a vertical projected area of 3 $mm^2$. The obtained pattern of valleys had almost the same depths between the discontinuous pebbles, and an average depth of 200 μm. The obtained pattern had almost the same vertical projected areas of valleys, that is, vertical projected areas of valleys from the upper surfaces which are perpendicular to the sheet surface for any valley, and an average vertical projected area of 2 $mm^2$. Further, the obtained pattern of valleys had an average distance between the valleys of 2.5 mm, and the total area of the projected areas of the valleys accounted for 9% of the surface area of the cover layer.

(2) A volleyball with the obtained sheet on the surface was produced, and the ball was evaluated in the same manner as in Example 1. The evaluation showed that, compared with a conventional volleyball (Comparative Example 1), the ball of the present invention flew to the intended position both when tossing the ball and when serving the ball, and moreover, the attenuation degree in the ball speed during flight of the ball was smooth compared with the conventional ball. Moreover, the ball had an abrasion resistance at a level causing no problems in practical use. Moreover, with respect to the cushioning property of the ball of the present invention, the impact felt by a player at the fingertips and arms when receiving the ball was a satisfactory level.

Example 3

(1) The same nonwoven fabric (1) of Example 1 was impregnated with a 13% dimethylformamide solution (100% modulus, 100 kg/$cm^2$) of polyester-based polyurethane in which polyethylene propylene adipate, 4,4'-diphenylmethane diisocyanate, and ethylene glycol were copolymerized. Immediately after that, the resultant nonwoven fabric was coated with a 20% dimethylformamide solution (100% modulus, 40 kg/$cm^2$) of polycarbonate-based polyurethane, which was composed of polyhexa carbonate glycol, polymethylene propylene adipate, and methylenediamine and in which n-hexane diisocyanate, 4,4'-diphenylmethane diisocyanate, and ethylene glycol were copolymerized. The resultant was coagulated in a coagulation bath at DMF/water ratio of 30/70 to form a porous structure. Then, polyethylene in fiber was extracted and removed by washing with hot water and hot toluene, yielding an artificial leather-like fibrous base material composed of a 6-nylon microfine fiber and a porous polyurethane.

(2) The fibrous base material was colored with an ester-based polyurethane ink including a yellow pigment. Then, embossing was performed at a temperature of 170° C., a pressure of 10 kg/cm, and an emboss rate of 1 m/minute by using an emboss roller having pebbles of a truncated pyramid shape with a height of 0.5 mm and a vertical projected area of 4 $mm^2$.

The obtained pattern of valleys had almost the same depths between the discontinuous pebbles, and an average depth of 250 μm. The obtained pattern had almost the same vertical projected areas of valleys, that is, vertical projected areas of valleys from the upper surfaces which are perpendicular to the sheet surface for any valley, and an average vertical projected area of 3 $mm^2$. Further, the obtained pattern of valleys had an average distance between the valleys of 2.0 mm, and the total area of the vertical projected areas of the valleys accounted for 19% of the surface area of the cover layer.

(3) Subsequently, embossing was performed thereon at a temperature of 150° C., a pressure of 6 kg/cm, and an emboss rate of 2 m/minute by using an emboss roller having pebbles of a truncated pyramid shape with a height of 70 mm and a vertical projected area of 0.03 $mm^2$, thereby forming secondary valleys at portions (top surface of a pebble) other than the valleys. The secondary valley had a depth of 48 μm and the total area of the vertical projected area of each valley accounted for 7% of the surface area of the cover layer.

(4) A volleyball with the obtained sheet on the surface was produced, and the ball was evaluated in the same manner as in Example 1. The evaluation showed that, compared with a conventional volleyball (Comparative Example 1), the ball of the present invention flew to the intended position both when tossing the ball and when serving the ball, and moreover, the attenuation degree in the ball speed during flight of the ball was smooth compared with the conventional ball. Moreover, the ball had an abrasion resistance at a level causing no problems in practical use.

A beach volleyball with the obtained sheet on the surface was produced and used. Evaluation results of the ball were the same as above.

Example 4

(1) The same procedure of Example 1 was followed except that embossing was performed at a temperature of 170° C., a pressure of 10 kg/cm, and an emboss rate of 1 m/minute by using an emboss roller having pebbles of a truncated pyramid shape with a height of 0.5 mm and a vertical projected area of 3 $mm^2$. The obtained pattern of valleys had almost the same depths between the discontinuous pebbles, and an average depth of 200 μm. The obtained pattern had almost the same vertical projected areas of valleys, that is, vertical projected areas of valleys from the upper surfaces which are perpendicular to the sheet surface for any valley, and an average vertical projected area of 2 $mm^2$. Further, the obtained pattern of valleys had an average distance between the valleys of 2.5 mm, and the total area of the projected areas of the valleys accounted for 9% of the surface area of the cover layer.

(2) Subsequently, embossing was performed thereon at a temperature of 150° C., a pressure of 6 kg/cm, and an emboss rate of 2 m/minute by using an emboss roller having pebbles of a truncated pyramid shape with a height of 55 mm and a vertical projected area of 0.08 $mm^2$, thereby forming secondary valleys at portions (top surface of a pebble) other than the valleys. The secondary valley had a depth of 40 μm and the total area of the vertical projected area of each valley accounted for 8% of the surface area of the cover layer.

A volleyball with the obtained sheet on the surface was produced, and the ball was evaluated in the same manner as in Example 1. The evaluation showed that, compared with a conventional volleyball (Comparative Example 1), the ball of the present invention flew to the intended position both when tossing the ball and when serving the ball, and moreover, the attenuation degree in the ball speed during flight of the ball was smooth compared with the conventional ball. Moreover, the ball had an abrasion resistance at a level causing no problems in practical use.

A beach volleyball with the obtained sheet on the surface was produced and used. Evaluation results of the ball were the same as above.

Example 5

(1) The same procedures of Example 1 (1) and (2) were followed until an elastic polymer cover layer was formed on the surface of a fibrous base material and discontinuous valleys were formed on the surface of a cover layer, thereby obtained a sheet.

Subsequently, embossing was performed thereon at a temperature of 150° C., a pressure of 6 kg/cm, and an emboss rate of 2 m/minute by using an emboss roller having pebbles of a truncated pyramid shape with a depth of 60 mm and a vertical projected area of 0.06 $mm^2$, thereby forming secondary valleys at portions (top surface of a pebble) other than the valleys. The secondary valley had a depth of 38 μm and the total area of the vertical projected area of each secondary valley accounted for 12% of the surface area of the cover layer.

(2) A volleyball covered with the obtained sheet was produced, and evaluation was performed in the same manner as in Example 1. As a result, compared with a conventional volleyball (Comparative Example 1), the ball of the present invention had properties, which were not realized by heretofore existing balls, such that the ball of the present invention flew to the intended position both when tossing the ball and when serving the ball, and moreover, the attenuation degree in the ball speed during flight of the ball was smooth. Moreover, the ball had an abrasion resistance at a level causing no problems in practical use. Even if the ball was actually used for about six months, tears or significant cracks due to abrasion were not observed and favorable controllability was maintained.

A beach volleyball with the obtained sheet on the surface was produced and used. Evaluation results of the ball were the same as above.

Comparative Example 1

The same procedure of Example 1 was followed except using an emboss roller providing a shape used for a common volleyball as a shape of valleys given with an emboss roller in Example 1. More specifically, the emboss roller provided a sheet whose surface was substantially flat and which had many pitting-grain-like patterns with a depth of about several micro meters. A volleyball with the obtained sheet on the surface was produced and used, and the abrasion resistance of the ball was a level causing no problems in practical use similarly as in Example 1. The controllability when tossing the ball was not so different from a heretofore-used ball, and the attenuation degree in the ball speed during flight was the same as that of a conventional ball. However, as being bothered by a conventional ball, the ball was likely to slip at the time of tossing the ball when it got wet with perspiration, and thus it was evaluated that the ball was extremely difficult to control.

A beach volleyball with the obtained sheet on the surface was produced and used. Evaluation results of the ball were the same as above.

Comparative Example 2

The same procedure of Example 1 was followed except that embossing was performed at a temperature of 170° C., a pressure of 10 kg/cm, and an emboss rate of 1 m/minute by using an emboss roller with a height of 1.0 mm and a vertical projected area of 8 $mm^2$, and having hemispherical pebbles. The obtained pattern of valleys had almost the same depths between the discontinuous pebbles, and an average depth of 400 μm. The obtained pattern had almost the same vertical projected areas of valleys, and an average vertical projected area of 4.9 $mm^2$. The obtained pattern of valleys had an average distance between the valleys of 1.3 mm. Further, the total area of the vertical projected areas of the valleys accounted for 34% of the surface area of the cover layer. A volleyball with the obtained sheet on the surface was produced and used, the abrasion resistance of the ball was a level causing no problems in practical use similarly as in Example 1. However, finger traction was strong when tossing the ball, and therefore it was evaluated that tossing the ball was difficult rather than that the controllability was good.

Comparative Example 3

The same procedure of Example 1 was followed except that embossing was performed at a temperature of 170° C., a pressure of 10 kg/cm, and an emboss rate of 1 m/minute by using an emboss roller with a height of 0.8 mm and a vertical projected area of 8 $mm^2$, and having hemispherical pebbles. The obtained pattern of valleys had almost the same depths between the discontinuous pebbles, and an average depth of 400 μm. The obtained pattern had almost the same vertical projected areas of valleys, and an average vertical projected area of 6.2 $mm^2$. The obtained pattern of valleys had an average distance between the valleys of 2.6 mm. Further, the total area of the vertical projected areas of the valleys accounted for 21% of the surface area of the cover layer. A volleyball with the obtained sheet on the surface was produced and used, the abrasion resistance of the ball was a level causing no problems in practical use similarly as in Example 1. However, finger traction was strong when tossing the ball, and therefore it was evaluated that tossing the ball was difficult rather than that the controllability was good.

Comparative Example 4

The same procedure of Example 1 was followed except that embossing was performed at a temperature of 170° C., a pressure of 10 kg/cm, and an emboss rate of 1 m/minute by using an emboss roller with a height of 0.8 mm and a vertical projected area of 3 $mm^2$, and having hemispherical pebbles. The obtained pattern of valleys had almost the same depths between the discontinuous pebbles, and an average depth of 400 μm. The obtained pattern had almost the same vertical projected areas of valleys, and an average vertical projected area of 1.8 $mm^2$. The obtained pattern of valleys had an average distance between the valleys of 7.4 mm. Further, the total area of the vertical projected areas of the valleys accounted for 2% of the surface area of the cover layer. A volleyball with the obtained sheet on the surface was produced and used, the abrasion resistance of the ball was a level causing no problems in practical use similarly as in Example 1. However, as being bothered by a conventional ball, the ball was likely to slip at the time of tossing the ball when it got wet with perspiration, and thus it was evaluated that the ball was extremely difficult to control.

INDUSTRIAL APPLICABILITY

The ball of the present invention has many discontinuous valleys, with the result that the controllability of the ball can be improved by suitably controlling a contact state between the fingertips and the ball surface when tossing the ball. Further, the ball of the present invention also has an outstanding non-slip property that resists slipping due to the secondary pebbles and valleys even when the ball gets wet with perspiration or water. In addition, the ball of the present invention is imparted with effects that deviation in the trajectory of the ball during flight when serving or the like is suppressed and the attenuation degree in the ball speed is apparently smooth. Therefore, the ball of the present invention is excellent not only in the controllability for all types of ball plays but also in the design. Thus, the ball of the present invention can be used very suitably as a ball which is hit directly with hand(s), such as a volleyball and beach volleyball.

The invention claimed is:

1. A sheet-like ball material for volleyball or beach volleyball, comprising:

a fibrous base material; and an elastic polymer cover layer that is laminated on a surface of the fibrous base material, wherein:

continuous pebbles and discontinuous valleys are formed on a surface of the elastic polymer cover layer;

each valleys discontinuously formed are formed at average intervals of 0.5 to 3 mm;

the valley has a depth of 50 to 500 μm;

a vertical projected area of each valley is 1 to 5 $mm^2$;

a total area of the vertical projected area of each valley accounts for 3 to 30% relative to a surface area of the elastic polymer cover layer; and wherein a sectional shape of the valley in a thickness direction is an arc shape or a hemispherical shape.

2. The sheet-like ball material according to claim 1, wherein secondary pebbles and valleys are formed on the surface of the elastic polymer cover layer, a depth of the secondary valleys being less than the depth of the discontinuous valleys and being within a range of 10 to 100 μm.

3. The sheet-like ball material according to claim 2, wherein the secondary pebbles and valleys are formed at portions other than the discontinuous valleys on the surface of the elastic polymer cover layer.

4. The sheet-like ball material according to claim 2, wherein the secondary pebbles and valleys are formed at upper surfaces of the continuous pebbles on the surface of the elastic polymer cover layer.

5. The sheet-like ball material according to claim 2, wherein:

the secondary valleys are discontinuous;

a vertical projected area of each secondary valley is 0.01 to 1 $mm^2$; and a total area of the vertical projected area of each secondary valley accounts for 1 to 30% relative to a surface area of the elastic polymer cover layer.

6. The sheet-like ball material according to claim 1, wherein the fibrous base material is a leather-like fibrous base material formed of a fiber-entangled fabric and a polymer.

7. The sheet-like ball material according to claim 1, wherein the fibrous base material is a fabric in which a polymer is impregnated in a three-dimensionally entangled non-woven fabric.

8. The sheet-like ball material according to claim 6, wherein the polymer is a polyurethane resin.

9. The sheet-like ball material according to claim 1, wherein the fibrous base material has a thickness of 0.4 to 3.0 mm.

10. The sheet-like ball material according to claim 1, wherein the elastic polymer is a polyurethane resin.

11. The sheet-like ball material according to claim 1, wherein the elastic polymer cover layer has a thickness of 0.1 to 3.0 mm.

12. A ball used for volleyball or beach volleyball comprising the sheet-like material according to claim 1.

13. The sheet-like ball material according to claim 1, wherein said depth of the valley is 200 to 350 μm.

14. The sheet-like ball material according to claim 1, wherein said vertical projected area of each valley is 2 to 3 $mm^2$.

15. The sheet-like ball material according to claim 1, wherein said total area of the vertical projected area of each valley accounts for 10 to 25% relative to a surface area of the elastic polymer cover layer.

* * * * *